US008939128B2

(12) United States Patent
Pirkl et al.

(10) Patent No.: US 8,939,128 B2
(45) Date of Patent: Jan. 27, 2015

(54) HIGH-PRESSURE INJECTOR

(75) Inventors: Richard Pirkl, Bulle (CH); Edgar Bignion, Paquier (CH); Wolfram Klemp, Berlin (DE)

(73) Assignee: Liebherr Machines Bulle SA, Bulle (CH)

( * ) Notice: Subject to any disclaimer, the term of this patent is extended or adjusted under 35 U.S.C. 154(b) by 872 days.

(21) Appl. No.: 13/095,377

(22) Filed: Apr. 27, 2011

(65) Prior Publication Data

US 2011/0271935 A1 Nov. 10, 2011

(30) Foreign Application Priority Data

May 7, 2010 (CH) ..... 706/10

(51) Int. Cl.

| | |
|---|---|
| ***F02M 59/00*** | (2006.01) |
| ***F02M 47/02*** | (2006.01) |
| ***F02M 55/00*** | (2006.01) |
| ***F02M 55/02*** | (2006.01) |
| ***F02M 61/16*** | (2006.01) |

(52) U.S. Cl.

CPC ..... *F02M 47/027* (2013.01); *F02M 55/002* (2013.01); *F02M 55/005* (2013.01); *F02M 55/025* (2013.01); *F02M 61/168* (2013.01); *F02M 2200/16* (2013.01); *F02M 2200/40* (2013.01)

USPC ..... 123/470; 239/533.2

(58) Field of Classification Search

CPC ... F02M 61/168; F02M 61/18; F02M 47/027; F02M 61/10; F02M 61/16; F02M 61/08; F02M 51/0603; F02M 51/0671; F02M 51/0682; F02M 51/0685; F03B 1/04; B05B 1/3046; B05B 17/0615; F23D 11/345

USPC ..... 239/533.2, 533.8, 533.9, 88, 89, 90, 91, 239/95, 533.3, 533.4, 533.12, 583, 584, 239/585.1, 585.4, 574, 124, 102.2, 5; 123/468, 470, 472, 469, 445, 447, 456, 123/467, 496

See application file for complete search history.

(56) References Cited

U.S. PATENT DOCUMENTS

| | | | | | |
|---|---|---|---|---|---|
| 4,081,140 | A | * | 3/1978 | Kranc | 239/533.9 |
| 4,418,671 | A | * | 12/1983 | Kelso et al. | 123/450 |
| 4,426,977 | A | * | 1/1984 | Taplin et al. | 123/446 |
| 4,566,416 | A | * | 1/1986 | Berchtold | 123/458 |

(Continued)

FOREIGN PATENT DOCUMENTS

| | | |
|---|---|---|
| DE | 4437927 | 4/1996 |
| DE | 19902282 | 8/2000 |

(Continued)

*Primary Examiner* — Hai Huynh
*Assistant Examiner* — Raza Najmuddin
(74) *Attorney, Agent, or Firm* — Dilworth & Barrese, LLP.

(57) ABSTRACT

The present invention shows a high-pressure injector having the following assemblies: an injector unit (1), a drive unit (2) for driving the injector unit (1), preferably a high-pressure storage unit (3) for supplying the injector unit (1) with fuel, and a high-pressure connection (4). Provision is made in this respect that the high-pressure injector has a housing (5) in which a plurality of the named assemblies are arranged behind one another in the longitudinal direction of the injector, wherein the housing (5) completely envelops at least one of the named assemblies, in particular the drive unit (2) and/or the high-pressure storage unit (3). The high-pressure injector with the injector unit can be used in all types of internal combustion engines, preferably in diesel engines.

20 Claims, 1 Drawing Sheet

(56) References Cited

U.S. PATENT DOCUMENTS

| | | | | |
|---|---|---|---|---|
| 5,241,935 | A * | 9/1993 | Beck et al. | 123/300 |
| 5,341,783 | A * | 8/1994 | Beck et al. | 123/446 |
| 5,467,754 | A * | 11/1995 | Beck et al. | 123/467 |
| 5,537,972 | A * | 7/1996 | Beck et al. | 123/198 DB |
| 5,551,391 | A * | 9/1996 | Beck et al. | 123/305 |
| 5,772,123 | A * | 6/1998 | Augustin et al. | 239/533.2 |
| 6,420,817 | B1 * | 7/2002 | Ricci-Ottati et al. | 310/316.01 |
| 6,494,383 | B2 * | 12/2002 | Augustin | 239/124 |
| 6,840,458 | B2 * | 1/2005 | Kuzuyama | 239/88 |
| 7,040,293 | B2 * | 5/2006 | Furukubo et al. | 123/467 |
| 7,516,906 | B2 * | 4/2009 | Cooke | 239/88 |
| 7,520,267 | B2 * | 4/2009 | Toyoshima | 123/447 |
| 7,552,717 | B2 * | 6/2009 | Dingle | 123/480 |
| 7,603,984 | B2 * | 10/2009 | Ganser | 123/456 |
| 7,900,605 | B2 * | 3/2011 | Dingle | 123/480 |
| 8,333,176 | B2 * | 12/2012 | Okuno et al. | 123/468 |
| 8,543,314 | B2 * | 9/2013 | Nakata et al. | 701/103 |
| 8,596,247 | B2 * | 12/2013 | Tower et al. | 123/470 |
| 2002/0008158 | A1 * | 1/2002 | Kuzuyama | 239/95 |
| 2002/0109014 | A1 * | 8/2002 | Augustin | 239/88 |
| 2004/0169094 | A1 * | 9/2004 | Bloching et al. | 239/533.2 |
| 2005/0045150 | A1 * | 3/2005 | Furukubo et al. | 123/447 |
| 2005/0173564 | A1 * | 8/2005 | Cooke | 239/533.1 |
| 2007/0215717 | A1 * | 9/2007 | Cooke | 239/102.2 |
| 2009/0038589 | A1 * | 2/2009 | Dingle | 123/480 |
| 2009/0223487 | A1 * | 9/2009 | Dingle | 123/447 |
| 2011/0041807 | A1 * | 2/2011 | Cooke | 123/445 |
| 2011/0271935 | A1 * | 11/2011 | Pirkl et al. | 123/470 |
| 2012/0012083 | A1 * | 1/2012 | Tower et al. | 123/468 |
| 2012/0080011 | A1 * | 4/2012 | Cooke | 123/472 |

FOREIGN PATENT DOCUMENTS

| | | | |
|---|---|---|---|
| DE | 19902282 | A1 * | 8/2000 |
| DE | 69712201 | | 10/2002 |
| DE | 202006002663 | | 4/2006 |
| DE | 102005039688 | * | 3/2007 |
| EP | 181479 | | 5/1986 |
| JP | 2009236113 | A * | 10/2009 |
| WO | 2007/143768 | | 12/2007 |

* cited by examiner

SECTION B–B

HIGH-PRESSURE INJECTOR

BACKGROUND OF THE INVENTION

The present invention relates to a high-pressure injector having an injector unit, having a drive unit for driving the injector unit and having a high-pressure connection. In an advantageous embodiment of the present invention, the high-pressure injector can furthermore have a high-pressure storage unit for supplying the injector unit with fuel.

Such a high-pressure injector is known, for example, from document WO 2007/009279 A1. In this respect, each high-pressure injector includes a high-pressure storage unit (accumulator) to which the injector unit is connected at the front side via a cap nut. The drive unit for driving the injector unit is integrated into the high-pressure storage unit. The high-pressure injector therefore has a relatively complicated construction and is therefore expensive in manufacture.

SUMMARY OF THE INVENTION

The present invention will therefore present a high-pressure injector which has a simple construction and which can be manufactured inexpensively.

This object is achieved in accordance with the invention by a high pressure injector described herein.

The high-pressure injector in accordance with the invention in this respect includes an injector unit, a drive unit for driving the injector unit and a high-pressure connection. In an advantageous embodiment of the present invention, the high pressure injector can furthermore include a high pressure storage unit for supplying the injector unit with fuel. Provision is now made In accordance with the invention that the high-pressure injector has a housing in which a plurality of assemblies are arranged behind one another in the longitudinal direction of the injector, wherein the housing completely envelops at least a first assembly, in particular the drive unit and/or the high-pressure storage unit. A particularly simple design of the high-pressure injector in accordance with the invention hereby results.

The assemblies arranged within the housing in this respect advantageously have fuel-conducting high-pressure zones which are closed toward the housing so that the housing serves as a second envelope for the fuel-conducting zones of the assemblies.

Further advantageously, the housing can in this respect serve the mechanical connection of the assemblies which are arranged behind one another in the longitudinal direction of the injector. The assemblies are in this respect in particular pressed onto one another via the housing.

The housing in this respect advantageously connects at least three assemblies, in particular three of the following assemblies: injector unit, drive unit for driving the injector unit, high-pressure storage unit for supplying the injector unit with fuel, high-pressure connection. The present invention is, however, not restricted to such an embodiment. One of the three assemblies can, for example, also be an intermediate piece which has high-pressure bores for conducting high-pressure fluid between two other assemblies.

The assemblies advantageously abut one another in at least two contact zones within the housing in accordance with the invention. They are there advantageously pressed tightly onto one another, with this pressing taking place by a force generated or transferred via the housing. The contact zones in this respect are advantageously contact planes which extend perpendicular to the longitudinal direction of the high-pressure injector. The high-pressure injector in accordance with the invention is hereby given a layer-wise structure in which the individual assemblies are arranged behind one another in the housing in the longitudinal direction of the injector.

The two contact zones are advantageously the contact zones of the first assembly, which is completely enveloped by the housing, with further assemblies. Further advantageously, still further contact zones are arranged between further assemblies in the housing.

In accordance with the invention, at least one of the assemblies advantageously has cut-outs in a contact zone to increase the contact pressure. The cut-outs thus provide that the contact surface between the assemblies is as small as possible in order thus to enable a tight connection via the higher contact pressure. In this respect, the cut-outs are advantageously configured symmetrically with respect to the center axis of the high-pressure injector to enable a uniform distribution of forces.

Further advantageously, at least two of the assemblies in accordance with the invention have axial high-pressure bores in the contact zones, said high-pressure zones being in communication with one another there. These axial high-pressure bores are in this respect in particular surrounded by contact surfaces which lie on one another in the contact zones and are so pressed with one another in a sealing manner.

In this respect, a plurality of parallel high-pressure zones are advantageously provided which are advantageously arranged symmetrically.

The assemblies advantageously form a contiguous high-pressure zone, which is closed toward the housing, within the housing for conducting the fuel, wherein leakage flows which may arise at the contact zones are collected in the region between the outer walls of the assemblies and the inner wall of the housing.

Further advantageously, in the high-pressure injector in accordance with the invention, leakage flows are collected within the housing and are conducted out of the housing via a common outlet. This outlet for the leakage flow is in this respect advantageously arranged in the region of the high-pressure connection. The high-pressure connection in this respect advantageously serves as a connection to a double-wall high-pressure line.

In accordance with the invention, the housing of the high-pressure injector is advantageously outwardly sealed by one or more O rings.

Further advantageously, in accordance with the invention, the housing has a connection zone for the shape-matched connection to a second assembly. In this respect, the housing can advantageously be screwed to a second assembly via the connection zone. The shape-matched connection in this respect advantageously allows a clamping of the housing to the assembly. A connection of the housing to the high-pressure connection advantageously takes place in so doing.

In a particularly preferred embodiment of the present invention, the housing is configured as a cap nut. The housing accordingly has an internal thread with which it can be screwed to the second assembly. The housing furthermore has an elongate enveloping body in which the further assemblies are arranged.

In addition to the embodiment of the connection zone of the housing as a threaded zone, alternative embodiments of the housing are also conceivable in which the connection zone is configured e.g. as a web zone on which a threaded element is supported. This also allows a connection of the housing to the second assembly by which the assemblies arranged in the housing are pressed onto one another in their contact zones and are thus sealingly connected to one another.

Further advantageously, the housing has an opening with an undercut with which it lies on a support zone of a third assembly of the high-pressure injector. The third assembly is thus held within the housing by the undercut and transmits the contact pressure of the housing onto the assemblies arranged in the interior of the housing. The support region is in this respect advantageously arranged at the injector unit.

A part region of the third assembly in this respect advantageously projects from the housing. In this respect, the nozzle arrangement of the injector unit advantageously projects out of the housing.

Further advantageously, the housing has a second opening through which the assemblies can be pushed into the housing or via which the housing can be pushed over the assemblies. The second opening is in this respect advantageously arranged in the connection zone and is in particular surrounded by it.

Further advantageously, the assemblies can be displaced in the housing in the longitudinal direction of the high-pressure injector on the assembly and are only fixed in the housing via the shape-matched connection of the housing to the second assembly.

Further advantageously, the housing in accordance with the invention in this respect has a rotationally symmetrical shape.

In a preferred embodiment of the present invention, the housing completely envelops at least two assemblies arranged behind one another in the longitudinal direction of the injector. These two assemblies are in particular the drive unit and the high-pressure unit.

As already mentioned above, the present invention can in particular be used in such high-pressure engines which have a high-pressure storage unit for supplying the injector unit with fuel. The integration of the high-pressure storage unit into the high-pressure injector has the advantage that a common rail system can be dispensed with since the fuel can in each case be buffered in the high-pressure injector.

In accordance with the invention, the first assembly, which is completely enveloped by the housing, is advantageously the drive unit and/or the high-pressure storage unit. The drive unit or the high-pressure storage unit are in this embodiment completely surrounded by the housing in the radial direction, wherein the housing advantageously additionally serves the connection of the drive unit or of the high-pressure storage unit to further assemblies of the high-pressure injector.

The high-pressure storage unit in accordance with the invention advantageously has a storage volume which corresponds to more than ten times a maximum injection volume during a cylinder cycle; further advantageously more than 10 times this volume; further advantageously more than 50 times this volume.

The high-pressure storage unit of the high-pressure injector in accordance with the invention advantageously has a jacket region in whose interior the storage zone of the high-pressure storage element is located. This jacket region in this respect advantageously serves the transfer of force between the assemblies within the housing. Further advantageously, the jacket forms an envelope closed toward the housing. The storage zone can in this respect be formed by an axial bore.

In a further advantageous manner, the high-pressure unit has a filter unit and/or restriction valve unit. In this respect, it is advantageously arranged to the side of the high-pressure connection at the high-pressure storage unit so that fuel can pass through the filter unit and/or restriction valve unit on flowing into the high-pressure store. The filter unit and/or restriction valve unit is in this respect advantageously pressed into the jacket of the high-pressure storage unit in an end region. The filter unit and/or restriction valve unit is in this respect advantageously arranged in a cartridge which is pressed into the jacket of the high-pressure storage unit. For this purpose, the jacket advantageously has a bore in the longitudinal direction of the high-pressure injector which receives the filter unit and/or restriction valve unit and opens into the storage zone.

The drive unit advantageously has a jacket region in which one or more high-pressure bores is or are arranged for supplying the injector unit with fuel. These bores in this respect advantageously connect the high-pressure store to the injector unit. Further advantageously, the drive zone of the drive unit is in this respect arranged within the jacket region. The high-pressure bores then conduct the fuel outwardly past the drive zone from the high-pressure store to the injector unit.

In this respect, in accordance with the invention, a plurality of bores are advantageously provided which lead to the injector unit. The bores are in this respect advantageously arranged symmetrically to ensure a uniform force distribution.

Further advantageously, the jacket region further serves the conducting of a drive element, in particular of an electromagnet or of a piezo element. The drive unit can in this respect work electromechanically or piezoelectrically. The drive zone of the drive unit is advantageously arranged in an axial bore of the jacket region which is in particular centrally arranged.

The injector unit advantageously also has a plurality of high-pressure lines which are connected to the high-pressure store, advantageously via the high-pressure lines in the drive element.

The injector unit in accordance with the invention advantageously has a central valve passage in which a valve plunger is arranged displaceably in the longitudinal direction of the injector. In this respect, the valve plunger is advantageously biased via a spring. Further advantageously, the valve plunger is moved via the drive unit in accordance with the invention.

The injector unit advantageously has a nozzle arrangement which serves the injection of fuel. In this respect, a plurality of high-pressure bores which supply the nozzle with fuel are advantageously provided in the injector jacket. In this respect, one or more high-pressure lines can advantageously be provided. They are advantageously arranged symmetrically.

The nozzle arrangement in the present invention can in this respect be arranged as a separate assembly at the tip of the injector unit. In a preferred embodiment, the nozzle arrangement is in this respect fastened to the tip of the injector unit via a cap nut. The injector unit together with the nozzle arrangement fastened thereto naturally has to be dimensioned in this respect so that it can be pushed through the front opening of the housing.

Further advantageously, electric contacts for controlling the drive unit are furthermore arranged in the region of the high-pressure connection of the high-pressure injector in accordance with the invention. The high-pressure connection thus furthermore serves the electric connection of the drive unit to a control in addition to the connection to a high-pressure system. Further advantageously, electric lines for controlling the drive unit can be arranged in the jacket region of the high-pressure store so that the drive unit is electrically connected via the high-pressure storage unit.

The high-pressure injector in accordance with the invention advantageously serves the fuel injection at a pressure of more than 200 bar, in particular at more than 1000 bar, in particular at more than 1500 bar. In this respect, the fuel is correspondingly pressurized via a pump and is provided to the high-pressure injector via the high-pressure connection. In this respect, the fuel is advantageously buffered in the high-pressure storage unit of the high-pressure injector.

In addition to the high-pressure injector, the present invention furthermore includes an internal combustion engine having one or more high-pressure injectors such as were described above. In this respect, the high pressure injector or injectors is/are advantageously fastened by means of the high-pressure connection in the cylinder block. In accordance with the invention, in those cases in which the injectors have an integrated high-pressure storage unit, a common rail arrangement can be dispensed with. The internal combustion engine in accordance with the invention is advantageously a diesel engine.

The present invention furthermore includes a method for manufacturing a high-pressure injector such as was presented above, comprising the steps: arranging at least three assemblies behind one another in the longitudinal direction of the injector as well as arranging the housing around the assemblies so that it envelops at least a first assembly completely. The first assembly is in this respect in particular the drive unit and/or the high-pressure storage unit. The housing in this respect advantageously envelops both the drive unit and the high-pressure storage unit completely.

Advantageously, in the method in accordance with the invention, the individual functional layers or assemblies of the high-pressure injector are arranged behind one another in the longitudinal direction of the injector on the assembly and are orientated toward one another so that high-pressure bore is arranged on high-pressure bore.

The housing is now advantageously installed, whereby the assemblies are pressed with one another. The installation of the housing in this respect advantageously takes place via a screw connection by which the contact pressure between the assemblies is also provided.

The nut of the screw connection can advantageously be elongated by hydraulic devices. The screwing process can then take place without force up to the release of the nut tensile force. Alternatively, the assemblies are pre-tensioned and are screwed to one another via the housing in accordance with the invention which is advantageously configured as a cap nut.

BRIEF DESCRIPTION OF THE DRAWINGS

The present invention will now be described in more detail with reference to an embodiment and to drawings.

There are shown

DESCRIPTION OF THE PREFERRED EMBODIMENTS

Figure 1:
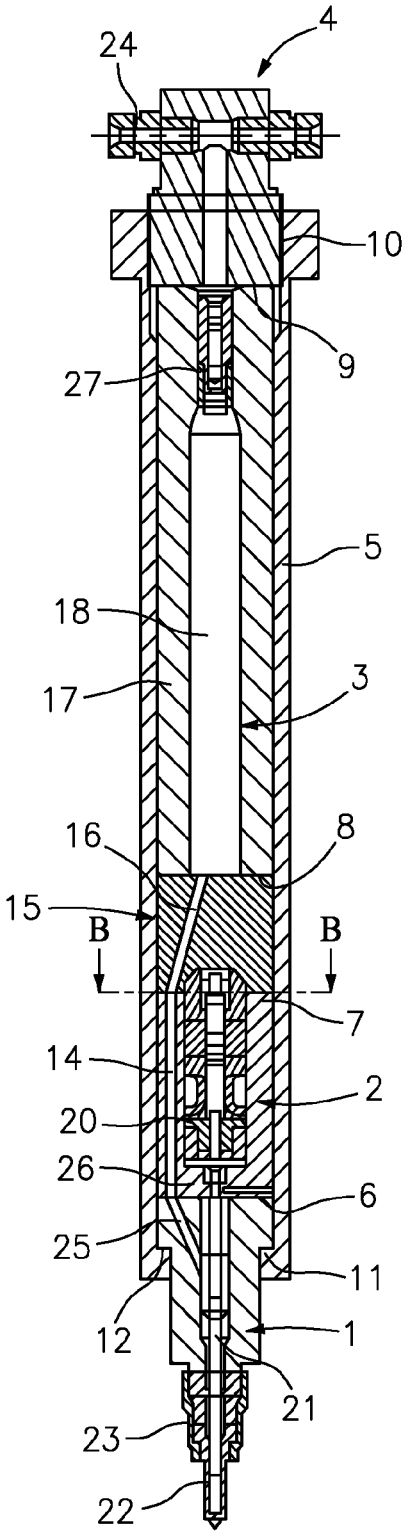
FIG. 1 the embodiment of a high-pressure injector in accordance with the invention in a sectional view through the longitudinal axis of the high-pressure injector.
Figure 2:
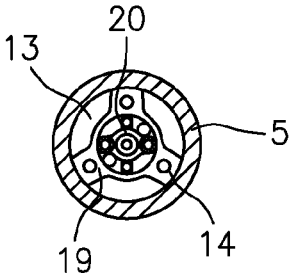
FIG. 2 a sectional view transversely to the longitudinal axis of the high-pressure injector along the sectional plane B-B in FIG. 1, that is, in a contact region between two assemblies.

An embodiment of a high-pressure injector in accordance with the invention is shown in FIGS. 1 and 2. The high-pressure injector in this respect includes an injector unit 1, a drive unit 2 for driving the injector unit 1, a high-pressure storage unit 3 for supplying the injector unit 1 with fuel and a high-pressure connection 4. The high-pressure injector in accordance with the invention furthermore has a housing 5. The injector unit 1, the drive unit 2, the high-pressure storage unit 3 as well as the high-pressure connection 4 are in this respect arranged behind one another in the longitudinal direction of the high-pressure injector and abut one another or an intermediate piece 15 in contact zones (which each lie between two assemblies).

The mechanical connection of the individual assemblies now takes place in accordance with the invention via the housing 5 which completely envelops the drive unit 2 and the high-pressure unit 3. The assemblies are in this respect arranged layer-wise behind one another in the longitudinal direction of the high-pressure injector within the housing and are pressed with one another via the housing.

The high-pressure zones arranged in the assemblies are sealingly connected to one another by the pressing in the contact zones between the individual assemblies so that the housing represents a second wall.

The housing 5 in the embodiment in this respect has the form of a hollow cylinder in which the drive unit 2 and the high-pressure storage unit 3 are arranged behind one another. The injector unit 1 is in this respect only arranged partly within the housing and its front-face part projects out of a front-face opening of the housing. In this respect, the housing 5 is supported by an undercut 11 on a supporting edge 12 of the injector unit.

On the rear side, the housing 5 has an opening through which the assemblies can be pushed into the housing. In this respect, the housing 5 has a connection zone 10 for connection with the high-pressure connection 4. In this respect, in the embodiment, the invention takes place via a screw connection with the high-pressure connection, for which purpose the housing has, in the connection zone 10, an internal thread by which the housing can be screwed onto an external thread of the high-pressure connection. Alternatively to this arrangement, however, a separate threaded element for connection to the high-pressure connection would also be conceivable.

In the embodiment, the housing 5 is configured rotationally symmetrically so that it can be screwed to the high-pressure connection like a normal cap nut and presses the assemblies arranged layer-wise with one another. In the embodiment, the housing thus has the form of a cap nut which is pushed over the stack of injector unit 1, drive unit 2 and high-pressure store 3 and clamps them with the high-pressure connection.

The assemblies in this respect each abut one another in contact planes 6 to 9 and are pressed onto one another there by the pressure of the housing so that the high-pressure lines of the assemblies ending in the contact surfaces are tightly connected to one another. Such a contact plane 7, here between the drive unit 2 and the intermediate piece 15, is shown in FIG. 2 in this respect. As can be recognized in FIG. 2, in this respect cut-outs 13 are provided to increase the contact pressure in the contact zone 19. An improved sealing of the high-pressure line 14 is hereby made possible. The exposure through the cut-outs 13 is in this respect carried out symmetrically to the surface center or to the longitudinal axis of the high-pressure injector.

As can likewise be recognized in FIG. 2, in this respect a plurality of high-pressure lines for connecting the high-pressure store to the injector unit are provided in the embodiment. In this respect, they are arranged symmetrically to achieve a uniform pressure distribution. In this respect, a jacket region 26 is provided in the region of the drive unit 2 and a receiving bore for the drive apparatus is located in the interior thereof. The high-pressure lines 14 in this respect extend outwardly in the jacket region around the centrally arranged receiving zone.

The high-pressure storage unit 3 also has a jacket region 17 which has an axial bore 18 which serves as a high-pressure store. In this respect, a cartridge assembly 27 having a filter and a restriction valve is pressed into the jacket region 17 toward the high-pressure connection.

Furthermore, in this respect, an intermediate piece 15 in which bores 16 for connecting the high-pressure storage zone 18 to high-pressure lines 14 in the jacket of the drive unit 2 are arranged is arranged between the drive unit 2 and the high-pressure storage unit 3.

The intermediate element 15 in this respect has bores 16 which connect the centrally arranged storage zone 18 to the high-pressure lines 14 of the drive unit 2 arranged in the jacket region. In the injector unit, corresponding high-pressure lines 25 are in turn provided which connect the high-pressure lines 14 arranged in the jacket region to the central valve passage. A valve plunger 21 which is moved via the drive apparatus 20 is arranged in the latter. The drive apparatus can in this respect takes place electromagnetically as in the embodiment or piezoelectrically, for example.

A nozzle arrangement 22 which is in turn fastened to the tip of the injector unit via a cap nut 23 is provided at the tip of the injector unit 1 projecting out of the housing 5. Potential breakage leaks at the contact zones of the assemblies 6 to 9 are collected within the housing 5 and are conducted outwardly in a common outlet in the region of the high-pressure connection 4. For this purpose, the high-pressure connection is connected to a conventional double-wall high-pressure line. For this purpose, conventional connection nipples 24 are accordingly screwed in the high-pressure connection, with the high-pressure connection in this respect taking over the function of the high-pressure inflow and outflow. The injector is then fastened via the high-pressure connection in the cylinder block.

The high-pressure connection furthermore also includes the electric contacts for the connection of the drive unit 2. The electric lines are in this respect conducted through the jacket region 17 of the high-pressure store 3 and the intermediate piece 15 to the drive unit 2.

For installation, the individual functional layers are arranged orientated toward one another so that high-pressure bore is aligned with high-pressure bore. The functional layers are then tensioned and screwed to the housing 5 configured as a cap nut. The housing 5 can in this respect be pushed over the stacked assemblies until its undercut 11 lies on the supporting plane 12 of the injector unit. The tensioning of the stack then takes place by screwing to the high-pressure connection 4.

In summary, the following innovations over the prior art result in the present invention.

The housing can be configured as a closed cap nut which completely envelops the drive region of the injector. The cap nut can furthermore also completely envelop the high-pressure store. The cap nut in this respect is supported at the front face on the injector unit and is screwed at the rear side to the high-pressure connection.

Potential breakage leaks at the contact zones of the assemblies are collected within the cap nut and are conducted to a common outlet which is preferably arranged in the vicinity of the high-pressure connection. The potential breakage leak is then connected to a standardized double-wall high-pressure line and thus drained off. The cap nut can be outwardly sealed by O rings.

The high-pressure injector is fastened via the high-pressure connection in the cylinder block. In this respect, standardized connection nipples are advantageously screwed in. The high-pressure connection furthermore advantageously includes the function of the electric contacting of the drive unit.

The high-pressure connection takes over the function of the high-pressure inflow, high-pressure outflow and sealing of the pressure store and is screwed tight by the cap nut. Furthermore, a cartridge assembly having a filter and a restriction valve can also be pressed in the pressure store.

A plurality of preferably symmetrically arranged bores are provided in the injector jacket for the low-loss linking of the fuel high-pressure between the store and the nozzle. In this respect, one or more high-pressure lines are advantageously provided.

The jacket of the drive assembly can furthermore also take over the function of a pressure screw and the conducting function of the magnets of the drive assembly.

In accordance with the invention, the pressure store, the jacket of the drive assembly and the injector unit are arranged behind one another in the longitudinal direction of the high-pressure injector. The individual planes in this respect abut one another in contact zones. The planes are in this respect advantageously exposed at the separation points so that a sufficient contact pressure remains for sealing the high-pressure conducting. The exposure in this respect advantageously takes place symmetrically to the surface center.

The functional layers are advantageously oriented in the installation, high-pressure bore to high-pressure bore, clamped and screwed to a cap nut. Alternatively, the nut can also be elongated by hydraulic devices and the screwing process then takes place force-free until the nut tensile force is released.

An extremely compact arrangement with a simple structure results by the present invention, wherein the housing serves as a second envelope of the assemblies arranged in the housing and serves their mechanical connection. The assemblies are in this respect in particular pressed onto one another in their contact zones by the pre-tension applied by the housing.

The invention claimed is:

1. A high-pressure injector having the following assemblies arranged in the following order in a longitudinal direction, an injector unit (1), a drive unit (2) upstream of the injector unit (1) and arranged for driving the injector unit (1), a high-pressure storage unit (3) upstream of the drive unit (2) and arranged for supplying the injector unit (1) with fuel, a high-pressure connection (4) upstream of the storage unit (3), and a housing (5) completely circumferentially enveloping and press-fit against the injector unit (1), drive unit (2) and high-pressure storage unit (3) arranged behind one another in the longitudinal direction.

2. A high-pressure injector in accordance with claim 1, wherein the named assemblies abut one another in at least two contact zones within the housing, such a contact zone lying in each case between two assemblies, and are sealingly pressed onto one another by the housing.

3. A high-pressure injector in accordance with claim 1, wherein the housing has a connection zone for shape-matched connection, in particular a screw connection to a second assembly, in particular to the high-pressure connection, and the housing is advantageously configured as a cap nut and/or expansion sleeve.

4. A high-pressure injector in accordance with claim 1, wherein the housing completely envelops at least two named assemblies arranged behind one another in the longitudinal direction of the injector, in particular the drive unit and the high-pressure storage unit.

5. A high-pressure injector in accordance with claim 2, wherein the housing has an opening with an undercut with which it lies on a supporting region of a third assembly of the high-pressure injector, in particular on a supporting region of the injector unit.

6. A high-pressure injector having the following assemblies:

an injector unit (1), a drive unit (2) situated adjacent the injector unit (1) for driving the injector unit (1), a high-pressure connection (4), and a high-pressure storage unit (3) situated between the high-pressure connection (4) and the drive unit (2), on a side of the drive unit (2) opposite the injector unit (1), for supplying the injector unit (1) with fuel, wherein the high-pressure injector has a housing (5) in which a plurality of the named assemblies (1, 2, 3) are arranged behind one another in the longitudinal direction of the injector, the housing (5) completely envelops at least a first named assemble, in particular the drive unit (2) and/or the high-pressure storage unit (3), at least one of the named assemblies has cut-outs (13) in one of the contact zones (7) between adjacent (2,3) enveloped by the housing (5), to increase the contact pressure, and the cut-outs (13) are configured symmetrically to a longitudinal axis of the high-pressure injector.

7. A high-pressure injector in accordance with claim 2, wherein the storage unit (3)has an axial high-pressure bore (18), the drive unit (2) has at least one axial high-pressure bore (16, 14) and the injector unit (1) has at one axial high-pressure contact bore (25) in the contact zones, said axial high-pressure bores (18, 16, 14, 25) being in communication with one another.

8. A high-pressure injector in accordance with claim 1, wherein the drive unit has a jacket region in which a plurality of high-pressure bores are arranged for supplying the injector unit with fuel, and the bores advantageously connect the high-pressure store to the injector unit.

9. A high-pressure injector in accordance with claim 6, wherein a plurality of bores are provided which are advantageously arranged symmetrically with respect to the longitudinal axis of the high-pressure injector; and/or the jacket region serves the conducting of a drive element of the drive unit.

10. A high-pressure injector in accordance with claim 1, wherein leakage flows are collected within the housing (5) and drained off from the housing (5) via a common outlet in the region of the high-pressure connection (4) arranged as a connection to a double-wall high-pressure line.

11. A high-pressure injector in accordance with claim 1, wherein the high-pressure storage unit (3) has a filter unit and/or restriction valve unit (27) which is pressed into an end region of the high-pressure storage unit (3) and surrounded by the high-pressure unit (3).

12. A high-pressure injector in accordance with claim 1, wherein the housing is outwardly sealed by one or more O rings.

13. A high-pressure injector in accordance with claim 1, wherein furthermore electric contacts for controlling the drive unit are arranged in the region of the high-pressure connection and/or electric lines for controlling the drive unit extend in grooves of the jacket region of the high-pressure storage unit.

14. An internal combustion engine having one or more high-pressure injectors in accordance with claim 1, wherein the high-pressure injector or injectors is/are advantageously fastened by the hydraulic connection in the cylinder block.

15. A method for manufacturing a high-pressure injector having a drive unit (2) situated adjacent an injector unit (1) for driving the injector unit (1), a high-pressure storage unit (3) situated between a high-pressure connection (4) and the drive unit (2), on a side of the drive unit (2) opposite the injector unit (1), for supplying the injector unit (1) with fuel, said method comprising the steps of:

arranging the injector unit (1), the drive unit (2), the high-pressure storage unit (3) and the high-pressure connection (4) behind one another in a longitudinal direction of the injector and aligning and pressing the same together; and arranging a housing (5) around the previously aligned and pressed injector unit (1), drive unit (2) and storage unit (3) so that the housing (5) completely envelops at least the drive unit (2) and/or the high pressure storage unit (3).

16. A high-pressure injector in accordance with claim 10, wherein the high-pressure connection (4) comprises connection nipples (24) screwed thereon.

17. A high-pressure injector in accordance with claim 1, wherein the drive unit (2) has at least one high-pressure line (14) therethrough, and additionally comprising an intermediate piece (15) having bores (16) connecting a high-pressure storage zone (18) within the high pressure storage unit (3) to the at least one high-pressure line (14) through the drive unit (2).

18. A high-pressure injector in accordance with claim 17, wherein the injection unit (1) comprises high-pressure lines (25) arranged to connect the high-pressure lines (14) of the drive unit (2) with a central valve passage, and additionally comprising a valve plunger (21) arranged in the central valve passage of the injection unit (1), and a drive apparatus (20) arranged within the drive (2) to move the valve plunger (21), and with the high-pressure lines (14) of the drive unit (2) spaced radially-outwardly from the drive apparatus (20).

19. A high-pressure injector in accordance with claim 6, wherein the drive unit (2) comprises high-pressure lines (14) positioned radially-outwardly from a centrally-arranged receiving zone along a longitudinal axis of the injector.

20. A high-pressure injector in accordance with claim 1, wherein the injector unit (1) comprises a supporting edge (12) positioned along a length thereof and the housing (5) comprises an undercut (11) at an internal end thereof and arranged to support the housing (5) on the supporting edge (12) of the injector unit (1), such that the injector unit (1) is only partially arranged within the housing (5) with a front face of the injector unit (10) projecting out of a front face opening of the housing (5).

* * * * *